US009216130B2

(12) United States Patent
Killian et al.

(10) Patent No.: US 9,216,130 B2
(45) Date of Patent: Dec. 22, 2015

(54) SUPPORT DEVICE

(76) Inventors: James M. Killian, Houston, TX (US); Dell Klotz, Houston, TX (US)

( * ) Notice: Subject to any disclaimer, the term of this patent is extended or adjusted under 35 U.S.C. 154(b) by 690 days.

(21) Appl. No.: 13/551,150

(22) Filed: Jul. 17, 2012

(65) Prior Publication Data

US 2014/0024978 A1 Jan. 23, 2014

(51) Int. Cl.
*A61H 1/02* (2006.01)
*A61H 3/00* (2006.01)

(52) U.S. Cl.
CPC ..... *A61H 1/0244* (2013.01); *A61H 1/0292* (2013.01); *A61H 3/00* (2013.01); *A61H 2201/12* (2013.01); *A61H 2201/1253* (2013.01); *A61H 2201/163* (2013.01); *A61H 2201/165* (2013.01); *A61H 2201/1621* (2013.01); *A61H 2201/1642* (2013.01)

(58) Field of Classification Search
CPC ..... A61H 1/0244; A61H 1/0292; A61H 3/00
USPC ..... 601/5, 23, 33, 34, 35; 602/5, 16, 19, 23, 602/32, 36; 128/845
See application file for complete search history.

(56) References Cited

U.S. PATENT DOCUMENTS

| | | | | |
|---|---|---|---|---|
| 4,829,989 | A | 5/1989 | Deamer et al. | |
| 4,969,452 | A | 11/1990 | Petrofsky et al. | |
| 5,421,810 | A | 6/1995 | Davis et al. | |
| 5,575,764 | A * | 11/1996 | Van Dyne | 602/26 |
| 6,039,707 | A | 3/2000 | Crawford et al. | |
| 2007/0270976 | A1 | 11/2007 | Deharde | |
| 2008/0161738 | A1 * | 7/2008 | Giesen | 602/19 |
| 2008/0228121 | A1 | 9/2008 | Hughes | |
| 2013/0131560 | A1 * | 5/2013 | Ferguson et al. | 601/33 |
| 2013/0296746 | A1 * | 11/2013 | Herr et al. | 601/34 |

OTHER PUBLICATIONS

PCT/US2013/050919 filed Jul. 17, 2013, International Search Report dated Dec. 16, 2013, 3 pages.

* cited by examiner

*Primary Examiner* — Quang D Thanh
(74) *Attorney, Agent, or Firm* — Douglas W. Rommelmann; Andrews Kurth LLP

(57) ABSTRACT

A support device (5) arranged to be removably secured to a user and having vertical (16) and horizontal (18) members. In one arrangement, a lower support assembly is arranged for attachment to the user's leg so that the support device assists the user in lifting the leg while taking a step. In an alternative arrangement, the lower support assembly is attached to the lower trunk of the user so that the support device assists in straightening the user's spine. The spring assembly (10) can be arranged to apply forward torque to the lower support assembly (8) relative to the upper support assembly (6), for leg lift assist, or backward torque to the lower support assembly for spine straightening assist.

19 Claims, 9 Drawing Sheets

SUPPORT DEVICE

BACKGROUND OF THE INVENTION

1. Field of the Invention

The invention relates generally to devices that provide support to a human body. In particular, the invention relates to devices designed to assist in lifting a user's leg while taking a step, or in straightening a user's spine.

2. Description of the Prior Art

Many neurological conditions cause proximal leg muscle weakness and pelvic instability. The proximal leg flexor muscles are situated between the knee and the pelvic bones. Such proximal leg muscle weakness may exist even though the lower leg muscles below the knee are not weak. The condition of pelvic instability is recognized by an apparent unsteadiness of gait which is due to pelvic sway and lack of lateral support muscles. The neurological conditions which cause proximal leg muscle weakness and pelvic instability include brain lesions on the side opposite the weak leg, and lesions in the spinal cord. Furthermore, lesions in the nerve roots, lumbar plexus, and femoral nerve can result in proximal leg muscle weakness and as a consequence, gait disorders. The neurological conditions described above are often placed into one of the following disease categories:

(1) Multiple Sclerosis (MS) with spastic muscle weakness, pelvic instability, and gait unsteadiness;

(2) Stroke with spastic hemiparesis;

(3) Degenerative, traumatic, and other spinal cord lesions; and (4) Inflammatory, auto-immune, and compressive lesions of the lumbar roots, lumbo-sacral plexus, and femoral nerves.

In addition, some physical conditions cause weakness of the thoracic spine extensor muscles, resulting in thoracic spine forward flexion. These physical conditions include spinal osteoporosis with kyphosis, as well as many muscle diseases, or myopathies, which can cause weakness of the shoulder girdle and thoracic extensor muscles. Any of the cerebral degenerative diseases, such as Parkinson's, can also affect posture, resulting in forward flexion of the trunk as a way to correct problems with gait or rigidity. Without extensor muscle correction, such as by exercise or extension, atrophy with further flexion problems may develop, along with eventual permanent spine flexion contractions.

Some devices have been developed to aid persons suffering from proximal leg muscle weakness. For example, U.S. Pat. No. 6,039,707 provides a pelvic support device having a trunk support member secured about the torso of a user, and a upper leg support member secured about a upper leg of the user. The device includes a pivot joint coupled to the torso and the upper leg support members that applies forward torque to the upper leg support member when the user takes a step. Similarly, back braces and other posture-aiding devices are known to help patients suffering from spine forward flexion.

There remains a need, however, for an improved support device which can be worn in one configuration to help a user with leg lift while walking or worn in another configuration for spine straightening.

3. Identification of Objects of the Invention

An object of the invention to provide a device that overcomes the disadvantages of the prior art.

Another object of the invention is to provide a support device that provides support to the body of a user suffering from muscle weakness.

Another object of the invention is to provide a support device that can be coupled to a user for assisting a user in lifting his leg when taking a step.

Another object of the invention is to provide a support device that can be strapped to a user's chest and leg to provide stabilization for lateral support muscles as an aid in overcoming pelvic sway or hip drop during walking.

Another object of the invention is to provide a support device for aiding a user to walk who has proximal leg muscle weakness.

Another object of the invention is to provide a support device that may be coupled to a user for assisting a user to straighten his spine.

Another object of the invention is to provide a support device that may be strapped to a user to correct thoracic spine forward flexion resulting from weakness of the thoracic spine extensor muscles.

SUMMARY OF THE INVENTION

The invention is embodied in a support device that can be alternatively used to aid in lifting the user's leg or straightening the user's spine. The support device includes an upper support assembly designed to be removably secured to a user. The upper support assembly has a vertical member and a horizontal member. The vertical member is designed for vertical alignment with the user's torso. The horizontal member is attached to the vertical member, and extends at least partially around a portion of the user's body. The support device, when configured as a walking assist device, further includes a lower support assembly that can be removably secured to the user's leg, and a spring assembly that is positioned between and attached to the upper support assembly and the lower support assembly. The spring assembly for the support device used to aid in lifting the user's leg is designed to apply torque to the lower support assembly relative to the upper support assembly.

The support device of the invention may be configured to provide support for weak thoracic spine extension muscles. In such a configuration, the upper support assembly is designed to be removably secured about the chest of a user, with the lower support assembly designed to be removably secured about the pelvis of the user at a vertical position below the upper support assembly. The support device in the spine straightening configuration also includes a spring assembly strapped to the user at a vertical position between the upper support assembly and the lower support assembly. The spring assembly is attached to the upper support assembly and the lower support assembly.

The spring assembly for both the leg lift arrangement and for the spine muscle arrangements includes a spring housing assembly, a power spring contained within the spring housing assembly, and a bearing positioned adjacent to the power spring within the spring housing assembly. The bearing is arranged and designed to maintain lateral alignment of the power spring. The spring assembly provides a torque to the lower support assembly relative to the upper support assembly for the leg lift arrangement, or vice versa for the spine muscle support arrangement.

BRIEF DESCRIPTION OF THE DRAWINGS

The invention is better understood by reading the detailed description of embodiments which follow and by examining the accompanying drawings, in which.

DESCRIPTION OF A PREFERRED EMBODIMENT OF THE INVENTION

Figure 1:
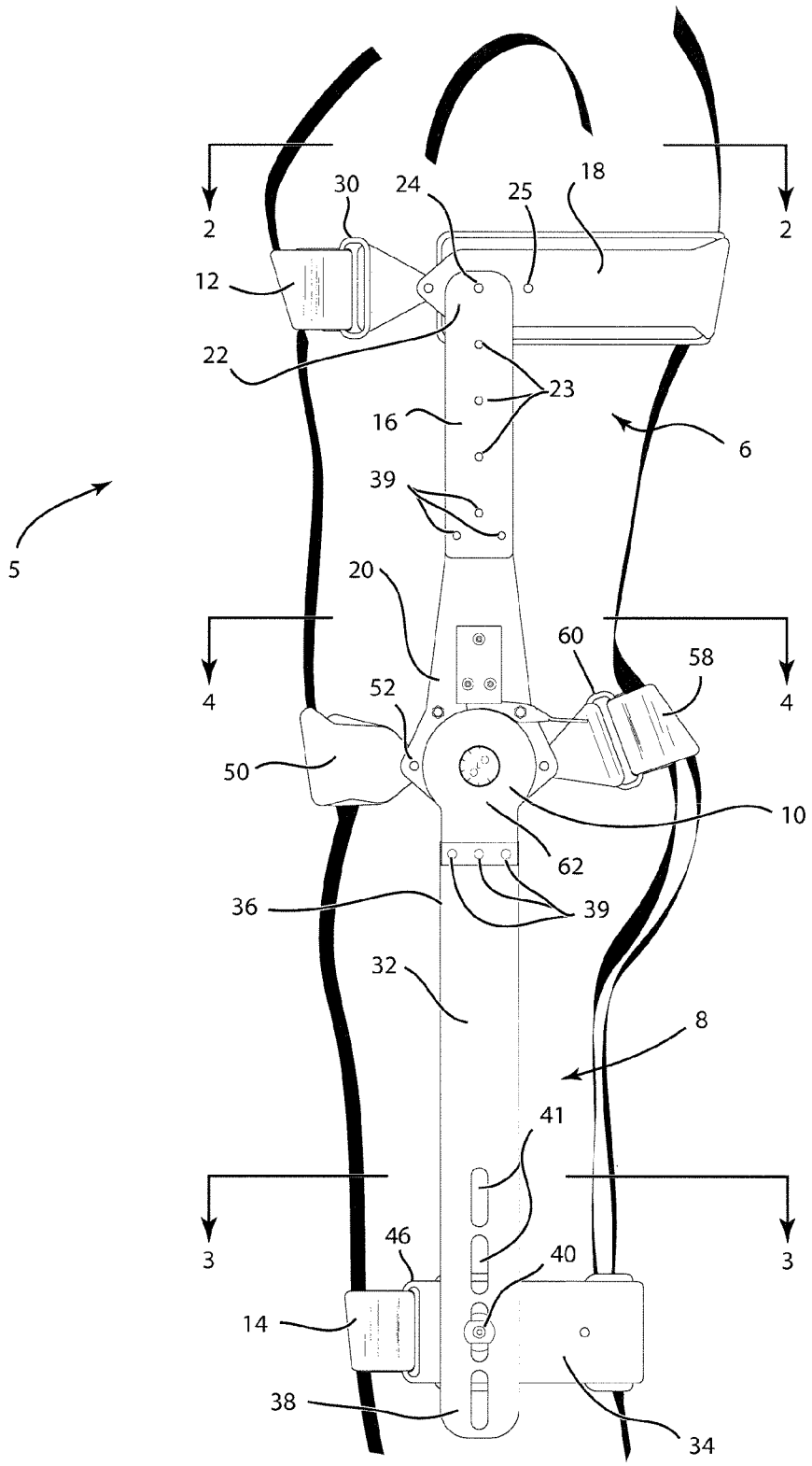
FIG. 1 is a side view of the support device according to an embodiment of the leg lift arrangement of the invention.

The aspects, features, and advantages of the invention mentioned above are described in more detail by reference to the drawings wherein like reference numerals represent like elements.

FIG. 1 shows the support device 5 strapped to a user's body for leg lift support which has an upper support assembly 6 connected to a lower support assembly 8 by a spring assembly 10. The support device 5 is strapped to a user's body by at least an upper strap 12, a lower strap 14, and a middle strap 58.

The upper support assembly 6 includes an upper vertical support member 16 and an upper horizontal support member 18. The upper vertical support member 16 has a first end 20 and a second end 22. The first end 20 is located at or near the spring assembly 10. The upper horizontal member 18 is preferably pivotally attached to the upper vertical member 16 at an upper pivot point 24. The upper pivot point 24 may be located at or near the second end 22 of the upper vertical member 16. Additional holes 23 may be provided on the upper vertical member 16 to allow for attachment of the upper horizontal member 18 at different places on the upper vertical member 16. Similarly, additional holes 25 may be provided in the upper horizontal member 18 to allow for adjustment of the upper horizontal member 18 laterally with respect to the upper vertical member 16.

Figure 2:
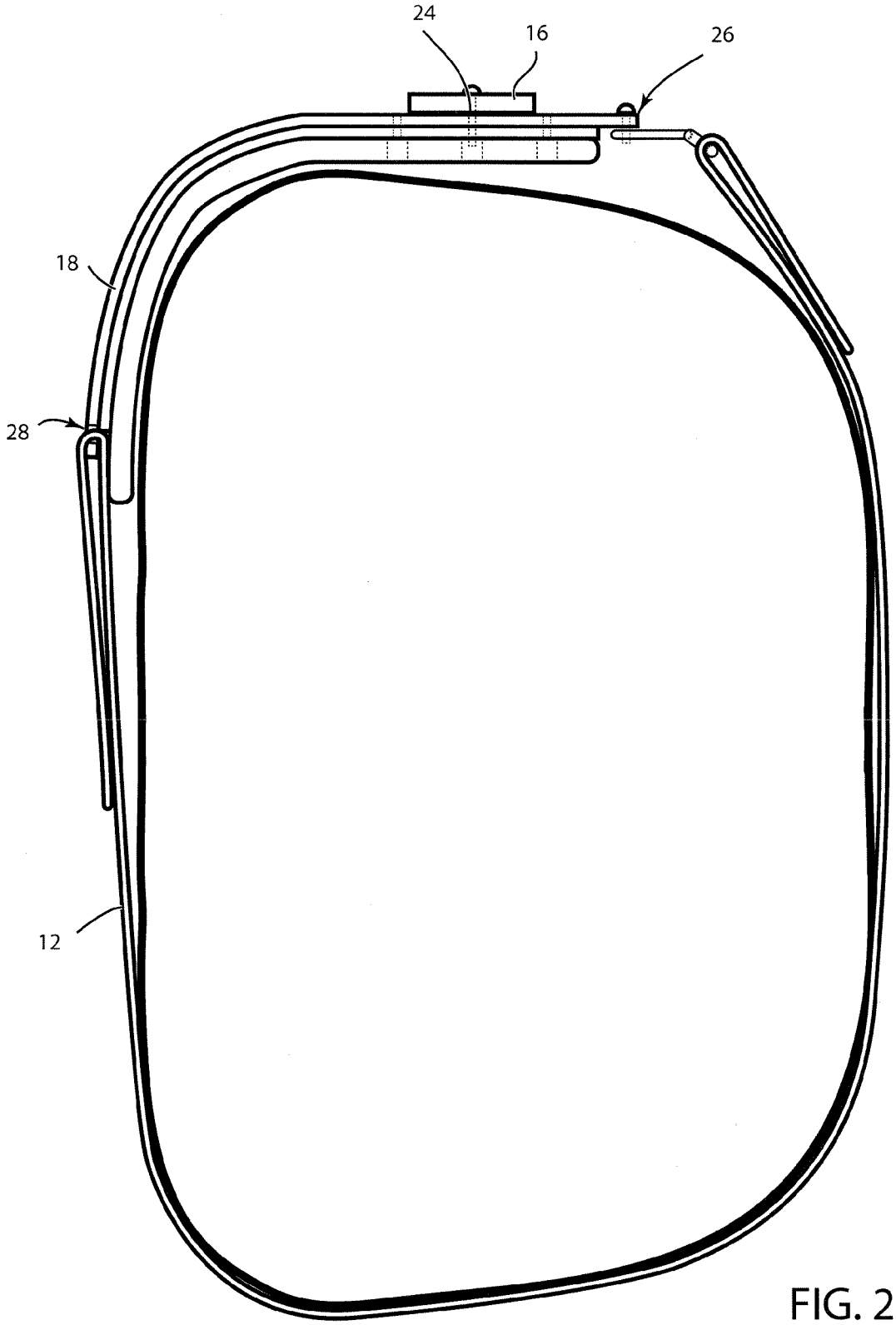
FIG. 2 is a downward looking view of the support device of FIG. 1 viewed from lines 2-2 of FIG. 1.

FIG. 2 shows a preferred arrangement for attaching the upper support assembly 6 to a user. The upper horizontal member 18 is attached to the upper vertical member 16 at the upper pivot point 24. The upper horizontal member 18 has a first end 26 proximate the upper pivot point 24, and a second end 28 remote from the upper pivot point 24. The upper strap 12 is designed to attach to the first end 26 and second end 28 of the upper horizontal member 18 and to surround the user. Preferably, the upper strap 12 is releasably attached to either the first end 26, the second end 28, or both. In one embodiment, the upper strap 12 includes hook and loop fasteners and the first and/or second ends 26, 28 of the upper horizontal member 18 have an upper strap receiving mechanism 30 (shown in FIG. 1). Preferably, the upper strap 12 passes through the upper strap receiving mechanism 30 and then attaches to itself by means of the hook and loop fasteners. Such an embodiment advantageously allows for easy adjustment of the upper strap 12 to accommodate users of different size.

FIG. 1 shows that the lower support assembly 8 includes a lower vertical member 32 and a lower horizontal member 34. The lower vertical member 32 has a first end 36 and a second end 38. The first end 36 of the lower vertical member 32 is located at or near the spring assembly 10.

The lower horizontal member 34 is preferably pivotally attached to the lower vertical member 32 at a lower pivot point 40. Additional holes 41 may be provided on the lower vertical member 32 to allow for attachment of the lower horizontal member 34 at different places on the lower vertical member 32. Similarly, additional holes (not shown) may be provided in the lower horizontal member 34 to allow for adjustment of the lower horizontal member 34 laterally relative to the lower vertical member 32.

Figure 3:
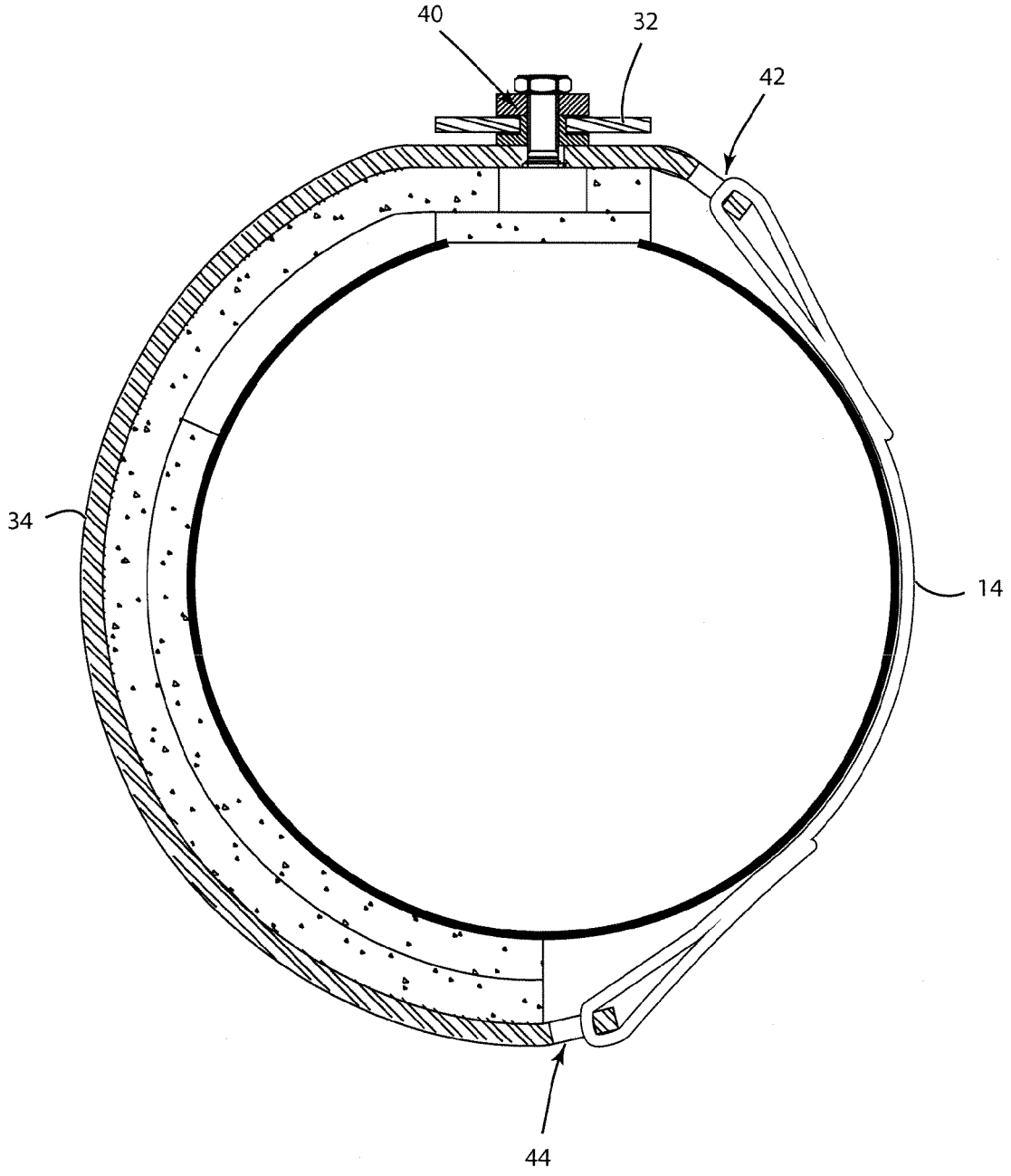
FIG. 3 is a downward view of the support device of FIG. 1 viewed from lines 3-3 of FIG. 1.

FIG. 3 presents a downward view of the support device 5 taken along line 3-3 of FIG. 1. FIG. 3 shows a preferred arrangement for attaching the lower support assembly 8 to a user's leg. The lower horizontal member 34 is attached to the lower vertical member 32 at a lower pivot point 40. The lower horizontal member 34 has a first end 42 next to the lower pivot point 40, and a second end 44 remote from the lower pivot point 40. The lower strap 14 is designed to attach to the first end 42 and second end 44 of the lower horizontal member 34. The strap 14 and lower horizontal member 34 are designed to be strapped about the user's leg. Preferably, the lower strap 14 is releasably attached to either the first end 42, the second end 44, or both. In a preferred embodiment, the lower strap 14 includes hook and loop fasteners, and the first and/or second ends 42, 44 of the lower horizontal member 34 have lower strap receiving ends 46 (as shown in FIG. 1). In this embodiment, the lower strap 14 passes through the lower strap receiving ends 46 and then attaches to itself by means of the hook and loop fasteners. Such an embodiment advantageously allows for easy adjustment of the lower strap 14 to accommodate users of different sizes.

The various components of the support device 5 (i.e., the upper vertical member 16, the upper horizontal member 18, the lower vertical member 32, and the lower horizontal member 34) may be made of any material of sufficient rigidity to provide the required support. For example, the components could be constructed of metal, such as aluminum or steel. Alternatively, the components could be constructed of rigid plastic. Furthermore, it is not necessary that all of the components be constructed of the same material. For example, some components can be constructed of metal, while others are constructed of plastic. In addition, foam padding may be provided on the portions of the support device that contact a user's body, such as the upper horizontal member 18, the lower horizontal member 34, and/or the middle support member 50 (discussed below). Such padding increases the comfort of the user while wearing the device.

The spring assembly 10 of FIG. 1 is attached to the first end 20 of the upper vertical member 16 and the first end 36 of the lower vertical member 32. The spring assembly 10 may be attached to the upper vertical member 16 and the lower vertical member 32 by fasteners 39. Alternatively, the spring assembly 10 may be integral to either the upper vertical member 16, the lower vertical member 32, or both. The spring assembly 10 includes a power spring 48 (shown in FIG. 5) arranged to provide torque to the lower vertical member 32 relative to the upper vertical member 16 or vice versa. In addition, a middle support member 50 is attached to the spring assembly 10. The middle support member 50 is preferably pivotally attached to the spring assembly 10 at a middle pivot point 52. From the middle pivot point 52, the middle support member 50 extends around the user's body to help maintain the position of the spring assembly 10 relative to the user's body.

Figure 4:
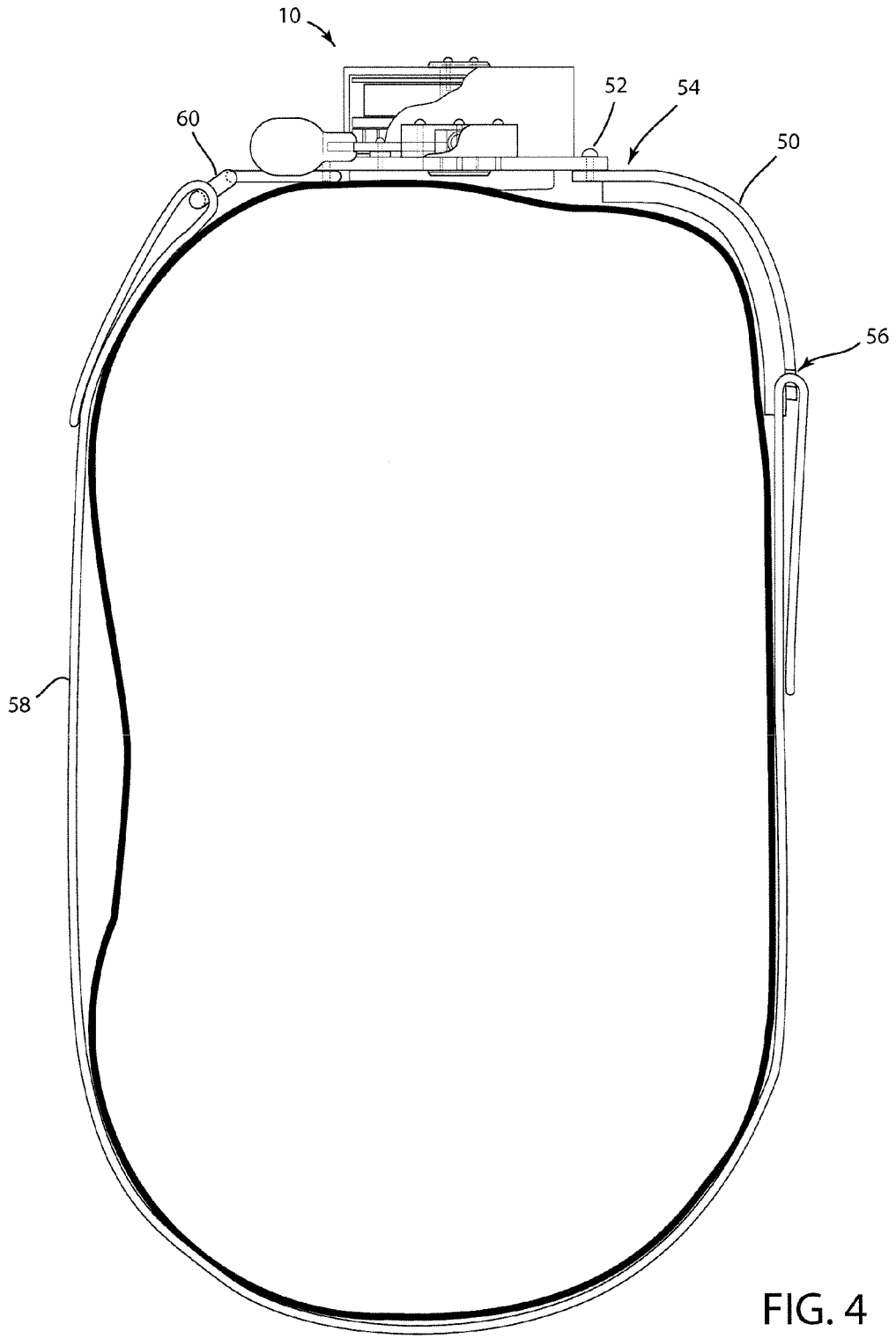
FIG. 4 is a downward view of the support device of FIG. 1 viewed from lines 4-4 of FIG. 1.

FIG. 4, shows a downward looking view of the support device 5 taken along line 4-4 of FIG. 1. FIG. 4 shows a preferred arrangement for further attaching the support device 5 to a user. As can be seen, the middle support member 50 is attached to the spring assembly 10 at a middle pivot point 52 for the leg lift arrangement of the support device. The middle support member 50 has a first end 54 attached to the spring assembly 10 at the middle pivot point 52, and a second end 56 remote from the middle pivot point 52. Preferably, a middle support strap 58 is attached to the second end 56 of the middle support member 50 and the spring assembly 10. The middle support strap 58 is designed to surround the user, attaching at one end to the second end 56 of the middle support member 50 by passing through a slotted end (not shown) of the middle support member 50, and at the other end by passing through a middle strap receiving mechanism 60 attached to the spring assembly 10. Preferably, the middle strap 58 is releasably attached to either the first end 56 of the middle support member 50, the middle strap receiving mechanism 60, or both. The middle strap 58 includes hook and loop fasteners that allow the strap to attach to itself after passing through the first end 56 of the middle support member 50 or the strap receiving mechanism 60. Such an embodiment advantageously allows for easy adjustment of the middle support strap 58 to accommodate users of different size.

Figure 5:
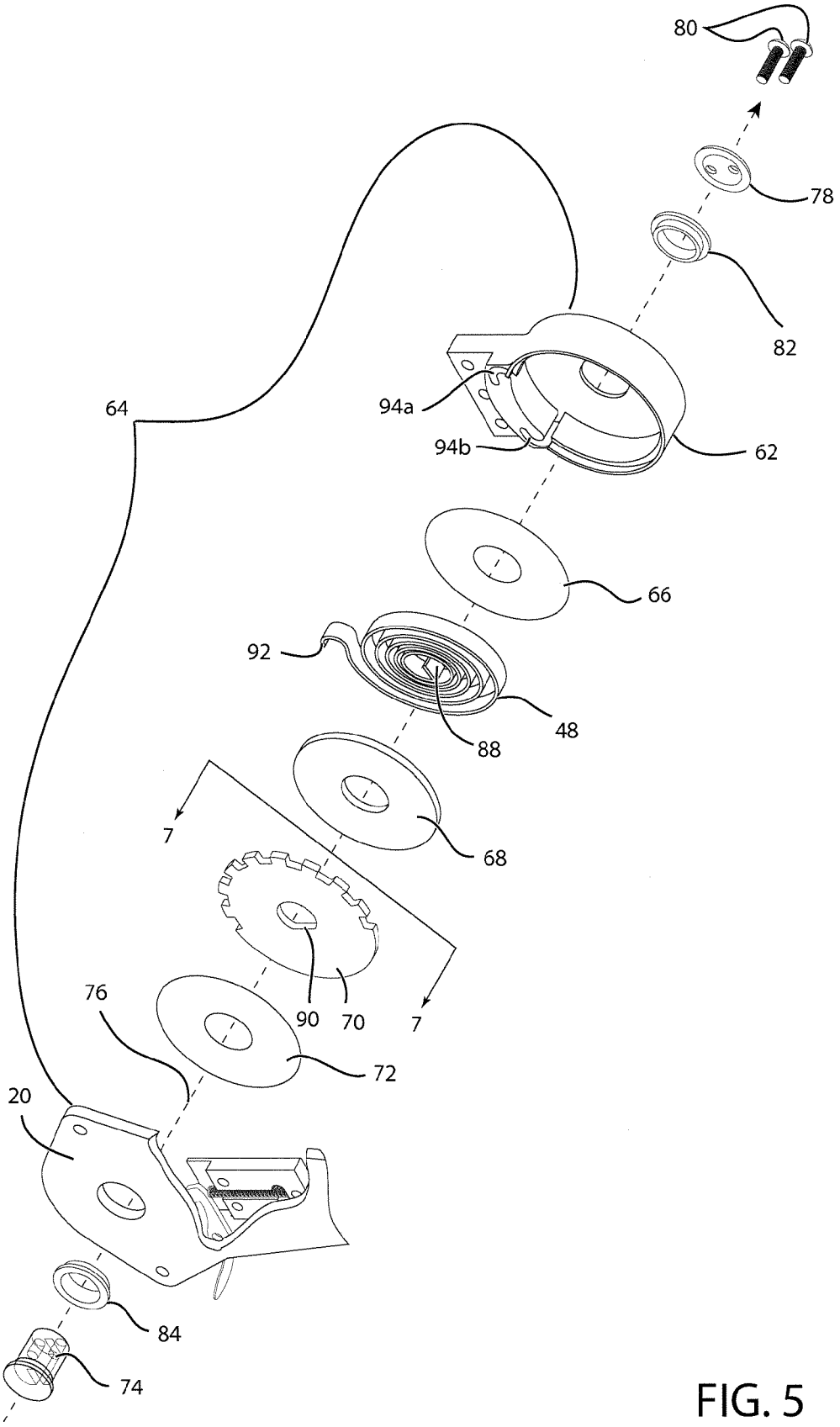
FIG. 5 is an exploded view of the spring assembly of the support device according to the arrangement of the support device used for leg lift.

FIGS. 5-7B show detailed aspects of the spring assembly 10. FIG. 5 is an exploded view of the components of the spring assembly 10, including the first end 20 of the upper vertical member 16, and an external housing 62 attached to, or integral with, the first end 36 of the lower vertical member 32 of the lower support assembly 8 (see FIG. 1). Together, these components comprise the external housing assembly 64. Within the external housing assembly 64 are at least five internal housing components. These internal housing components are positioned from the external housing 62 to the first end 20 of the vertical trunk component as follows: first antifriction disc 66, power spring 48, spacer bearing 68, sprocket wheel 70, and second antifriction disc 72. The internal housing components are coupled together within the external housing assembly 64 by means of a pivot pin 74 that passes through the components of the external housing assembly 64 and each of the internal housing components along the longitudinal axis 76 of the spring assembly 10. The pivot pin 74 is attached to a cap 78 on the opposite side of the external housing assembly 64 by at least one fastener 80. Journal bearings 82, 84 may optionally be placed between the pivot pin 74 and cap 78, and the external housing components.

Figure 6:
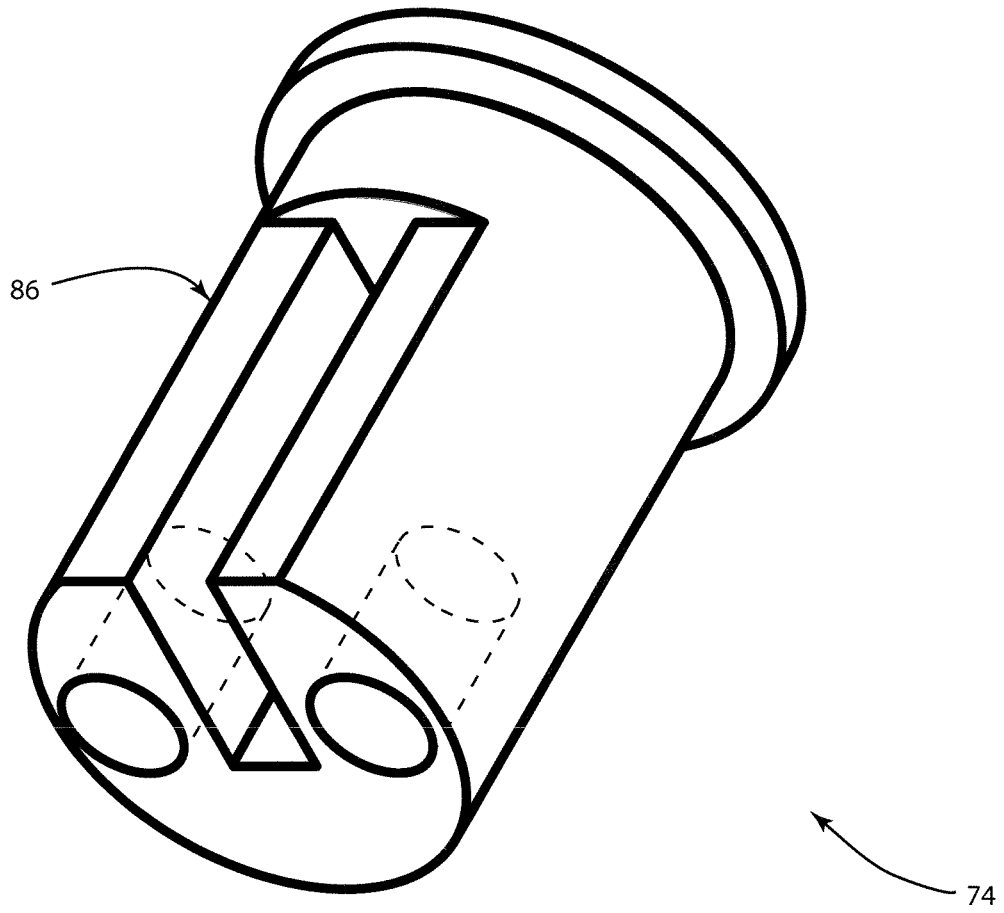
FIG. 6 is a perspective view of the pivot pin 74 of FIG. 3, rotated 180° from its position in FIG. 5.

FIG. 6, shows that pivot pin 74 includes a flat surface 86. The purpose of the flat surface 86 is to maintain the relative alignment of the power spring 48 and the sprocket wheel 70. To accomplish this, and as shown in FIG. 5, power spring 48 includes a flat spring tang 88 and the sprocket wheel 70 has a flat surface 90. When the spring assembly 10 is assembled, the flat spring tang 88 and the flat surface 90 of the sprocket wheel correspond to the flat surface 86 of the pivot pin 74. Accordingly, any radial movement of the sprocket wheel 70 rotates the pivot pin 74, which in turn rotates the tang 88 of the power spring 48.

The power spring 48 includes a spring hook 92 that is shaped to fit into one of two spring hook slots 94*a*, 94*b* in the external housing 62. The purpose of providing two spring slots 94*a*, 94*b* is so that the power spring 48 may be reversed within the external housing 62, thereby enabling the power spring 48 to provide forces in more than one direction. This feature allows use of the support device 5 in different positions on the user, including, for example, on either the right or left side of a user. Thus configured, when the housing is fully assembled, the spring is constrained at its tang 88 by the pivot pin 74, and at its hook 92 by the external housing 62. When coupled as described, any rotation of the spring tang 88 (such as, for example, by rotating the sprocket wheel 70) will increase or decrease the elastic potential energy in the spring. It is the elastic potential energy stored in the spring that provides a torque to the spring assembly 10.

Figure 7A:
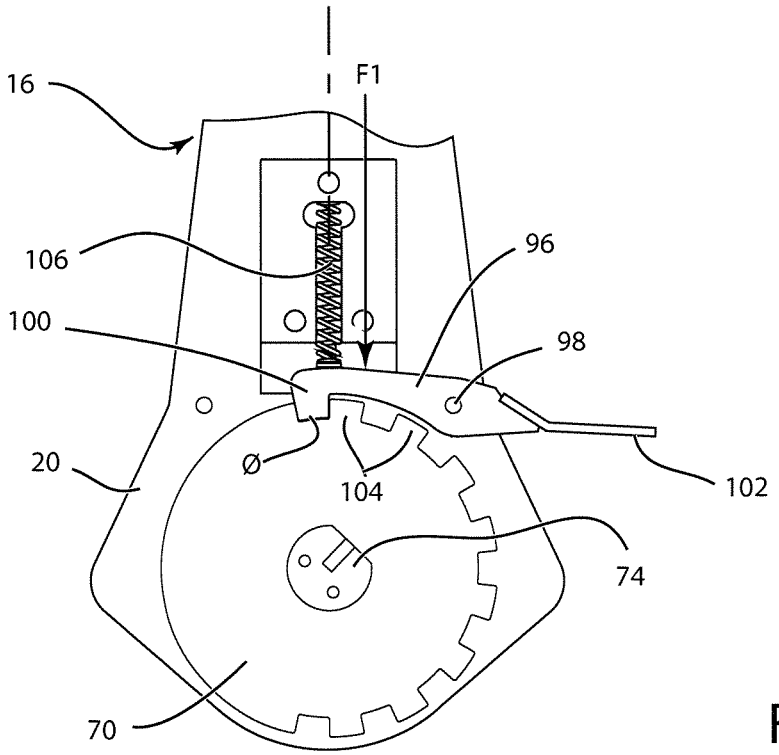
FIG. 7A is a collapsed view taken along line 7-7 of FIG. 5, where the latch 96 is engaged with the teeth 104 of the sprocket wheel 70.
Figure 7B:
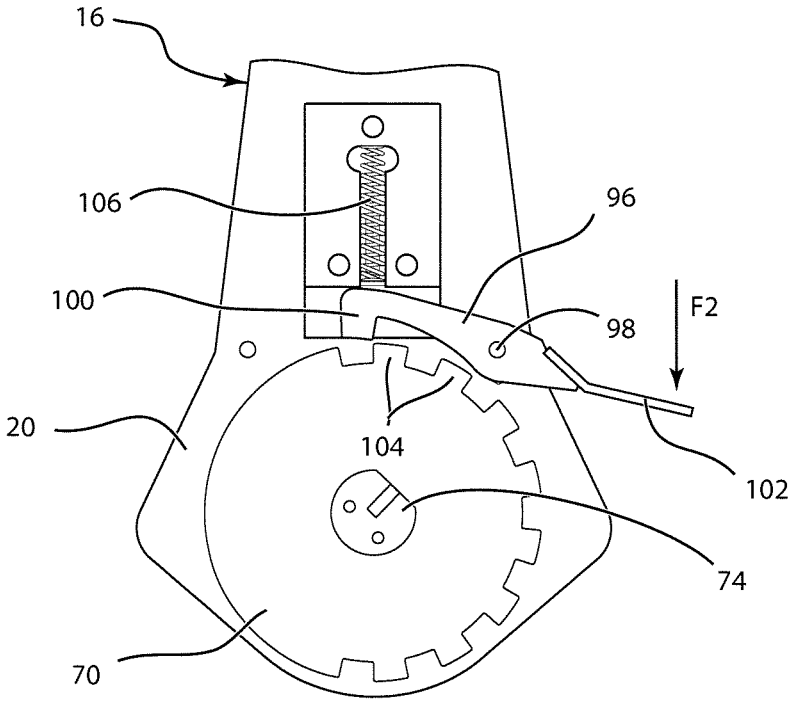
FIG. 7B is a collapsed view taken along line 7-7 of FIG. 5, where the latch 96 is disengaged from the teeth 104 of the sprocket wheel 70.

FIGS. 7A and 7B show a collapsed view of the support device 5 taken along line 7-7 of FIG. 5. The sprocket wheel 70 is attached to the first end 20 of the upper vertical member 16 by pivot pin 74. Also connected to the first end 20 of the upper vertical member 16 is a latch 96 that pivots around a latch pivot point 98. The latch includes a lug 100 at one end and a control lever 102 at the other end. In its neutral position, shown in FIG. 7A, the latch 96 is positioned so that the lug 100 engages the teeth 104 of the sprocket wheel 70. The latch is maintained in this position by a spring 106 that exerts a force F1 on the latch. Preferably, the teeth 104 have a slightly negative rake angle θ, designed to prevent the lug 100 from unintentionally slipping out of contact with the teeth 104. With the latch 96 in this position, the sprocket wheel 70 is prohibited from rotating by the interaction between the lug 100 of the latch 96 and the teeth 104 of the sprocket wheel 70.

As shown in FIG. 7B, if a user desires to rotate the sprocket wheel 70, thereby adjusting the elastic potential energy in the power spring 48 (as discussed above), the user may apply a force F2, which force is larger than force F1, to the control lever 102. The application of force F2 causes the latch 96 to pivot about the latch pivot point 98, thereby removing the lug 100 from engagement with the teeth 104 of the sprocket wheel 70. Such disengagement allows for radial adjustment of the sprocket wheel 70, which in turn adjusts the level of deliverable elastic potential energy in the power spring 48.

As shown in FIG. 5, a spacer bearing 68 is positioned between the power spring 48 and the sprocket wheel 70. The spacer bearing 68 maintains lateral alignment of the pivot pin 74 with spring enclosure 62. The spring assembly 10 will still function without the spacer bearing 68. However, in the absence of the spacer bearing 68, the spring enclosure 62 could lose parallelism with the first end 20 of the upper vertical member 16, causing binding that could increase internal friction and decrease the capability of the power spring 48 to effectively store or release elastic potential energy. The spacer bearing 68, by maintaining the lateral alignment of pivot pin 74, minimizes such possible problem. It is preferred that spacer bearing 68 and journal bearings 82, 84, be made of acetyl acetate plastic. The acetyl acetate plastic construction of the spacer bearing 68, as well as the polyflourocarbon material of first and second antifriction discs 66, 72, helps reduce friction between the internal components of the spring assembly 10.

Figure 8:
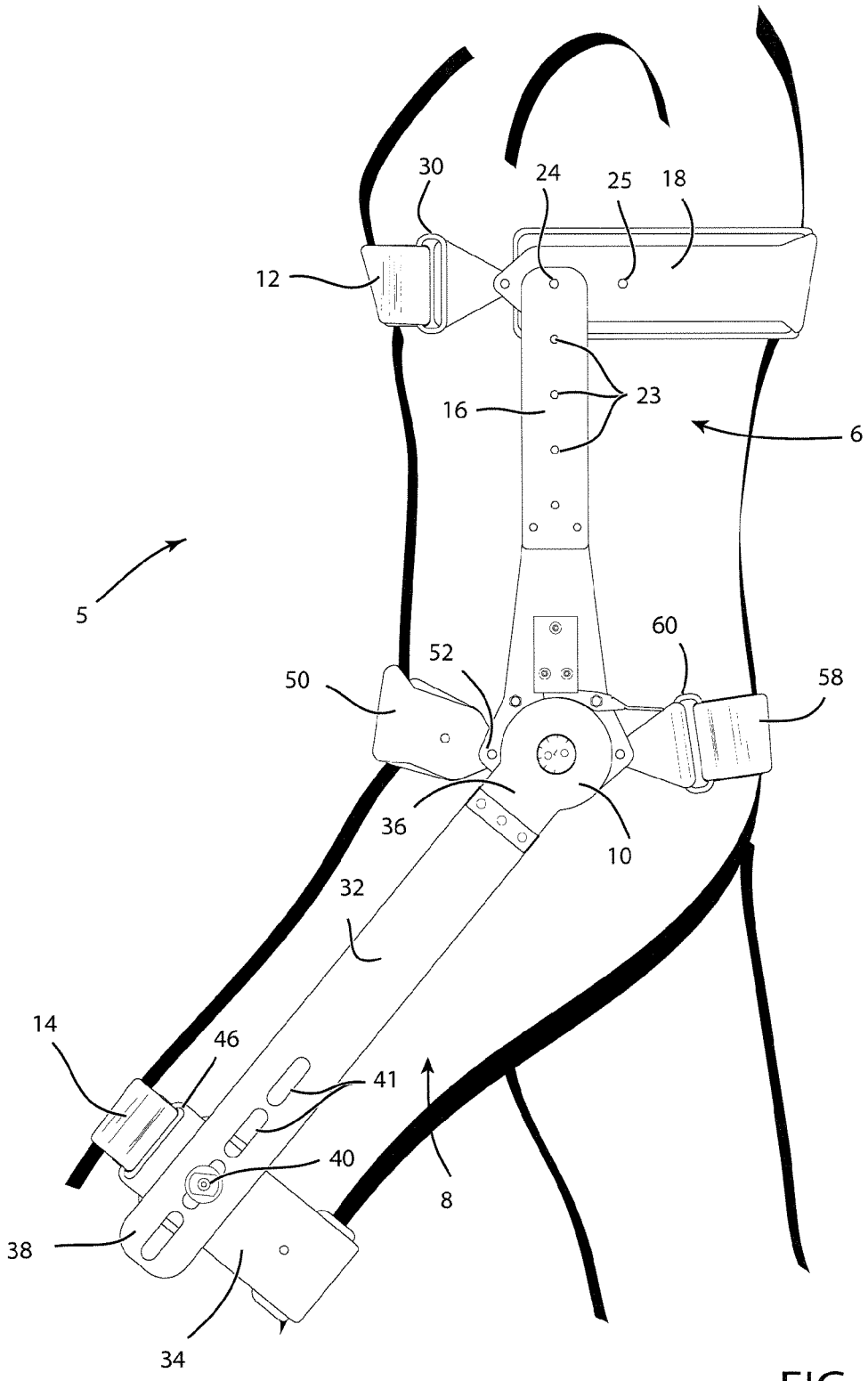
FIG. 8 is a side view of the support device arrangement used for leg lift with the lower support assembly raising the upper leg.
Figure 9:
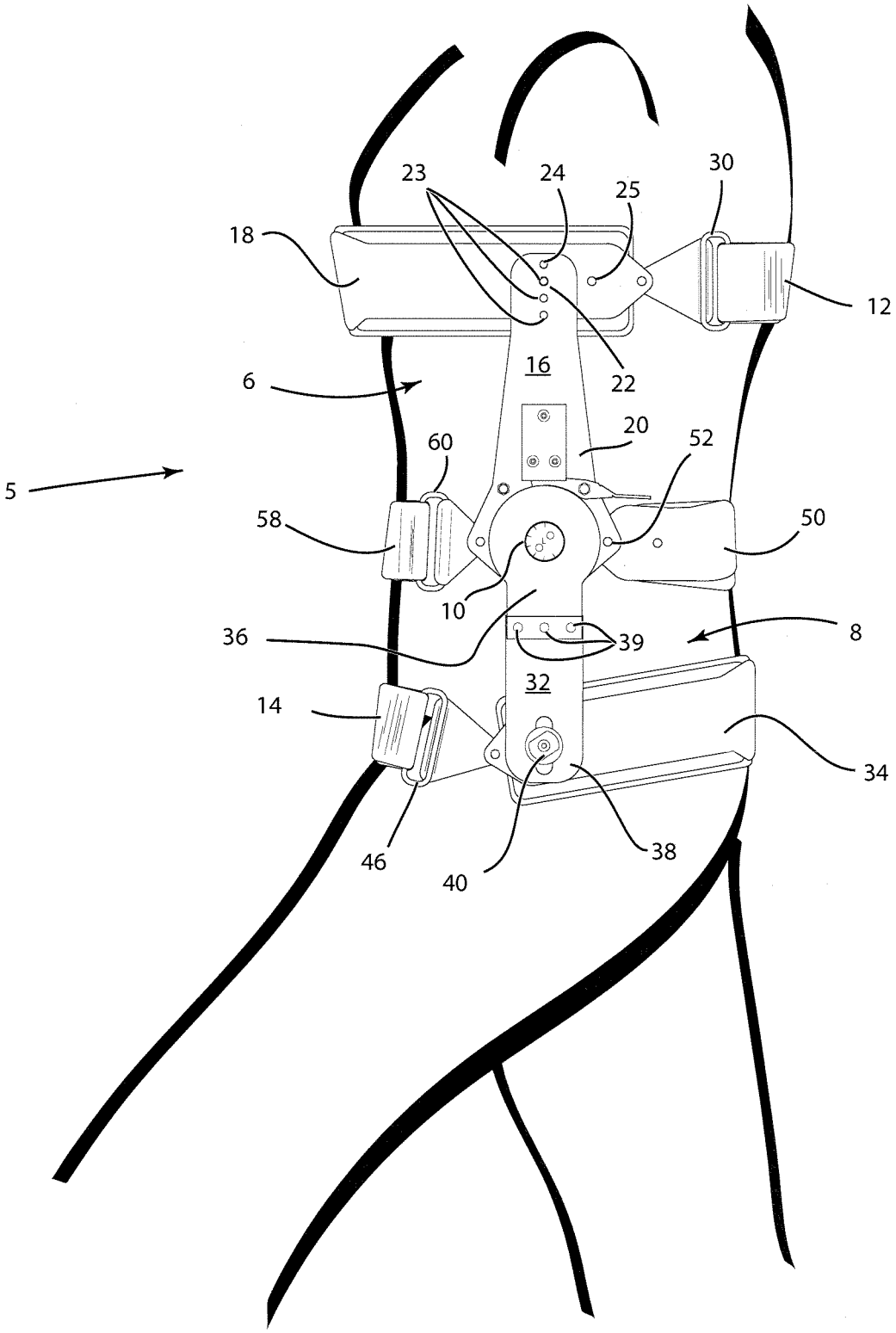
FIG. 9 is a side view of the support device arrangement worn by a user for spine muscle support and to achieve spine straightening.

FIGS. 8 and 9 show two different applications of the support device 5, including the walking assistance device (FIG. 8), and a spine straightening device (FIG. 9), respectively. Details of each of these embodiments are disclosed below.

Walking Assistance Embodiment

FIG. 8 shows a support device 5 of the invention used to help a user walk by lifting the user's leg. In this embodiment, the upper strap 12 attaches the upper support assembly 6 to the trunk of the user. The lower strap 14 attaches the lower support assembly 8 to the upper leg of the user. The middle strap 58 surrounds the user at the position vertically aligned with the superior lateral groin of the user. The support device 5 is preferably positioned on the user so that the spring assembly 10 is positioned over the hip of the user. The support device 5 is illustrated for lifting a left leg of a user, but of course it may be used for lifting a right leg by appropriate repositioning of the upper support assembly 6 and lower support assembly 8 to the right side and leg of the user.

In the walking assistance arrangement, the upper vertical member 16 is designed so that, when the support device 5 is attached to the user, the upper vertical member 16 is aligned with the trunk of the user, substantially along the midaxillary line of the user. Preferably, the upper horizontal member 18 attaches to the upper vertical member 16 at or near a position parallel to the base of the user's sternum. The additional holes 23 provided on the upper vertical member 16 allow for attachment of the upper horizontal member 18 at different places on the upper vertical member 16 depending on the length of a user's trunk. Preferably, from the upper pivot point 24, the upper horizontal member 18 extends around the user's body in a posterior direction. Additional holes 25 may be provided in the upper horizontal member 18 to allow for adjustment of the upper horizontal member 18 to fit users having different sized trunks. Thus configured, the upper vertical member 16 of the upper support assembly 6 provides stability to the support device 5 in a medial/lateral direction with respect to the user's trunk, and the upper horizontal member 18 provides stability in an anterior/posterior direction.

In this arrangement, the upper strap 12 is designed to surround the trunk of the user. Preferably, the upper strap 12 is releasably attached to the upper horizontal member 18, and is adjustable. This advantageously allows for easy adjustment of the upper strap 12 to accommodate users having different sized trunks.

In addition, when the support device 5 of the walking assistance arrangement is attached to the user, the lower vertical member 32 is aligned with the upper leg of the user, parallel to the longitudinal axis of the femur. The additional holes 41 provided on the lower vertical member 32 allow for attachment of the lower horizontal member 34 at different places on the lower vertical member 32 depending on the length of a user's upper leg. Preferably, from the lower pivot point 40, the lower horizontal member 34 extends around the user's upper leg in a posterior direction. Additional holes (not shown) may be provided in the lower horizontal member 34 to allow for adjustment of the lower horizontal member 34 to fit users having different sized upper legs. Thus configured, the lower vertical member 34 of the lower support assembly 8 provides stability to the support device 5 in a medial/lateral direction with respect to the user's upper leg, and the lower horizontal member 34 provides stability in an anterior/posterior direction.

In this embodiment, the lower strap 14 is designed to surround the upper leg of the user. Preferably, the lower strap 14 is releasably attached to lower horizontal member 34, and is adjustable. This advantageously allows for easy adjustment of the lower strap 14 to accommodate users having different sized upper legs.

As discussed above, the spring assembly 10 contains a power spring 48 (shown in FIG. 5) arranged to provide a forward torque to the lower support assembly 8 relative to the upper support assembly 6. As shown in FIG. 8, this forward torque is large enough to assist the user in lifting the user's leg when the support device 5 is attached to the user as disclosed in relation to the walking assistance embodiment.

Spine Straightening Embodiment

FIG. 9 illustrates the support device 5 as used in practice to help straighten a user's spine. In this arrangement, the upper strap 12 attaches the upper support assembly 6 to the upper trunk of the user, and the lower strap 14 attaches the lower support assembly 8 to the lower trunk of the user. In addition, the middle strap 58 surrounds the user at the position level with the spring assembly 10. The support device 5 in this arrangement is preferably positioned on the user so that the spring assembly 10 is positioned over the lateral trunk of the user.

In the spine straightening arrangement, the upper vertical member 16 is designed so that, when the support device 5 is attached to the user, the upper vertical member 16 is aligned with the trunk of the user, substantially along the midaxillary line of the user. The additional holes 23 provided on the upper vertical member 16 allow for attachment of the upper horizontal member 18 at different places on the upper vertical member 16 depending on the length of a user's trunk. Preferably, from the upper pivot point 24, the upper horizontal member 18 extends around the user's body in an anterior direction. Additional holes 25 may be provided in the upper horizontal member 18 allow for adjustment of the upper horizontal member 18 to fit users having different sized trunks. Thus configured, the upper vertical member 16 of the upper support assembly 6 provides stability to the support device 5 in a medial/lateral direction with respect to the user's upper trunk, and the upper horizontal member 18 provides stability in an anterior/posterior direction.

In this arrangement, the upper strap 12 is designed to surround the upper trunk of the user. Preferably, the upper strap 12 is releasably attached to the upper horizontal member 18, and is adjustable. This advantageously allows for easy adjustment of the upper strap 12 to accommodate users having different sized upper trunks.

In addition, when the support device 5 of the spine straightening arrangement is attached to the user, the lower vertical member 32 is aligned with the trunk of the user along the midaxillary line. In one embodiment, additional means are provided on the lower vertical member 32 to allow for attachment of the lower horizontal member 34 at different places on the lower vertical member 32 depending on the length of a user's trunk. Preferably, from the lower pivot point 40, the lower horizontal member 34 extends around the user's trunk in a posterior direction. Again, additional means may be provided in the lower horizontal member 34 to allow for adjustment of the lower horizontal member 34 to fit users having different sized lower trunks. Thus configured, the lower vertical member 34 of the lower support assembly 8 provides stability to the support device 5 in a medial/lateral direction with respect to the user's lower trunk, and the lower horizontal member 34 provides stability in an anterior/posterior direction.

In this embodiment, the lower strap 14 is designed to surround the upper leg of the user. Preferably, the lower strap 14 is releasably attached to the lower horizontal member 34, and is adjustable. This advantageously allows for easy adjustment of the lower strap 14 to accommodate users having different sized lower trunks.

Still with reference to FIG. 9, the spring assembly contains a power spring 48 (as shown in FIG. 5). In this embodiment, the power spring 48 is arranged to provide a backward torque to the upper support assembly 6 relative to the lower support assembly 8. This backward torque is large enough to assist the user in straightening the user's spine when the support device 5 is attached to the user as disclosed in relation to the spine straightening embodiment.

While some embodiments of the invention have been illustrated in detail, the invention is not limited to the embodiments shown. For example, the support device 5 of the present invention may be used on the leg of a user, with the upper support assembly 6 attached to the upper leg, the lower support assembly attached to the lower leg, and the spring assembly aligned with the knee. Such an embodiment of the device assists a user in bending the knee. In addition, modifications and adaptations of the above embodiments may occur to those skilled in the art. Such modifications and adaptations are in the spirit and scope of the invention as set forth herein.

What is claimed is:

1. A support device (5), comprising:

an upper support assembly (6) arranged and designed to be removably secured to a user and having an upper vertical member (16) and an upper horizontal member (18), said upper vertical member (16) designed for vertical alignment with the user, and said horizontal member (18) pivotally attached to said vertical member (16) and designed to extend at least partially around a portion of the user's body;

a lower support assembly (8) arranged and designed to be removably secured to the user at a vertical position below the upper support assembly (6);

a middle support member (50) arranged and designed to be removably secured to the user; and a spring assembly (10) designed to be attached to the user at a vertical position between said upper support assembly (6) and said lower support assembly (8), said spring assembly (10) attached to said upper support assembly (6) and said lower support assembly (8), and arranged and designed to apply torque to said lower support assembly (8) relative to said upper support assembly (6), or vice versa, said middle support member (50) pivotally attached to said upper vertical member (16).

2. The support device (5) of claim 1, wherein said upper support assembly (6) is arranged and designed to be removably secured to the trunk of a user, said lower support assembly (8) is arranged and designed to be attached to the upper leg of a user, and said spring assembly is arranged and designed to apply forward torque to said lower support assembly (8) when the user takes a step, thereby raising the user's upper leg.

3. The support device (5) of claim 1, wherein said upper support assembly (6) is arranged and designed to be removably secured to the upper trunk of a user, said lower support assembly (8) is arranged and designed to be attached to the lower trunk of a user, and said spring assembly is arranged and designed to apply continuous backward torque to said upper support assembly (6) to help straighten a user's spine.

4. The support device (5) of claim 1, wherein said spring assembly (10) comprises, a sprocket wheel (70) capable of fixed attachment to said upper support assembly (6), and a power spring (48) having a spring tang (88) and a spring hook (92), said sprocket wheel (70) and said power spring (48) substantially contained within an external housing assembly (64), wherein said spring tang (88) is connected to said sprocket wheel (70) by a pivot pin (74), said pivot pin (74) configured to prohibit movement of said sprocket wheel (70) relative to said spring tang (88), and wherein said spring hook (92) is fixedly engaged with said lower support assembly (8).

5. The support device (5) of claim 2, wherein said upper support assembly (6) is attached to the trunk of a user with an adjustable, releasable trunk strap (12).

6. The support device (5) of claim 2, wherein said lower support assembly (8) is attached to the upper leg of a user with an adjustable, releasable upper leg strap (14).

7. The support device (5) of claim 2, wherein, said middle support member (50) attached to said support device (5) at a position adjacent to said spring assembly (10) and extending in an anterior direction around the body of the user to maintain the position of said spring assembly (10) against the body of the user substantially at or around the superior lateral groin of the user.

8. The support device (5) of claim 7, wherein, said spring assembly is designed for attachment to the user with an adjustable, releasable middle strap (58) attached to said middle support member (50) and surrounding at least a portion of the user's body.

9. The support device (5) of claim 4, wherein said power spring (48) is reversible within said external housing assembly (64), thereby enabling said power spring (48) to provide a relative torque between said upper support assembly (6) and said lower support assembly (8) in more than one direction.

10. A support device (5), comprising:

an upper support assembly (6) arranged and designed to be removably secured to a user;

a lower support assembly (8) arranged and designed to be removably secured to the user at a vertical position below the upper support assembly (6);

a middle support member (50) arranged and designed to be removably secured to the user; and a spring assembly (10) adapted to be attached to the user at a vertical position between said upper support assembly (6) and said lower support assembly (8), and attached to said upper support assembly (6) and said lower support assembly (8), said spring assembly (10) comprising:

a spring housing assembly (64);

a power spring (48) contained within said spring housing assembly (64); and a bearing (68) positioned adjacent said power spring (48) within said spring housing assembly (64), said bearing (68) arranged and designed to maintain lateral alignment of said power spring (48);

wherein said spring assembly (10) provides a torque to said lower support assembly (8) relative to said upper support assembly (6), or vice versa, said middle support member (50) pivotally attached to said upper support assembly (6).

11. The support device (5) of claim 10, wherein said upper support assembly (6) is arranged and designed to be removably secured to the trunk of a user, said lower support assembly (8) is arranged and designed to be attached to the upper leg of a user, and said spring assembly is arranged and designed to apply forward torque to said lower support assembly (8) when the user takes a step, thereby raising the user's upper leg.

12. The support device (5) of claim 10, wherein said upper support assembly (6) is arranged and designed to be removably secured to the upper trunk of a user, said lower support assembly (8) is arranged and designed to be attached to the lower trunk of a user, and said spring assembly is arranged and designed to apply continuous backward torque to said upper support assembly (6) to help straighten a user's spine.

13. The support device (5) of claim 10, wherein said spring assembly (10) further comprises, a sprocket wheel (70) capable of fixed attachment to said upper support assembly (6), wherein said power spring (48) has a spring tang (88) and a spring hook (92), wherein said spring tang (88) is connected to said sprocket wheel (70) by a pivot pin (74), said pivot pin (74) configured to prohibit movement of said sprocket wheel (70) relative to said spring tang (88), and wherein said spring hook (92) is fixedly engaged with said lower support assembly (8).

14. The support device (5) of claim 10, wherein said upper support assembly (6) is designed for attachment to the user with an adjustable, releasable trunk strap (12).

15. The support device (5) of claim 10, wherein said lower support assembly (8) is designed for attachment to the user with an adjustable, releasable upper leg strap (14).

16. The support device (5) of claim 10, wherein, said middle support member (50) designed for attachment to said support device (5) at a position adjacent to said spring assembly (10) and extending at least partially around the body of the user.

17. The support device (5) of claim 16, further comprising, an adjustable, releasable middle strap (58) attached to said middle support member (50) and designed to surround at least a portion of the body of the user.

18. The support device (5) of claim 13, wherein said power spring (48) is reversible within said spring housing assembly (64), thereby enabling said power spring (48) to provide a relative torque between said upper support assembly (6) and said lower support assembly (8) in more than one direction.

19. A support device (5), comprising:

an upper support assembly (6) arranged and designed to be removably secured to a user and having an upper vertical member (16) and an upper horizontal member (18), said upper vertical member (16) designed for vertical alignment with the user, and said horizontal member (18) attached to said vertical member (16) and designed to extend at least partially around a portion of the user's body;

a lower support assembly (8) arranged and designed to be removably secured to the user at a vertical position below the upper support assembly (6);

a middle support member (50) arranged and designed to be removably secured to the user; and a spring assembly (10) designed to be attached to the user at a vertical position between said upper support assembly (6) and said lower support assembly (8), said spring assembly (10) attached to said upper support assembly (6) and said lower support assembly (8), and arranged and designed to apply torque to said lower support assembly (8) relative to said upper support assembly (6), or vice versa, said middle support member (50) pivotally attached to said spring assembly (10), wherein said spring assembly (10) comprises:

a sprocket wheel (70) capable of fixed attachment to said upper support assembly (6), and a power spring (48) having a spring tang (88) and a spring hook (92), said sprocket wheel (70) and said power spring (48) substantially contained within an external housing assembly (64), wherein said spring tang (88) is connected to said sprocket wheel (70) by a pivot pin (74), said pivot pin (74) configured to prohibit movement of said sprocket wheel (70) relative to said spring tang (88), and wherein said spring hook (92) is fixedly engaged with said lower support assembly (8).

* * * * *